US006332613B1

(12) United States Patent
Reese

(10) Patent No.: US 6,332,613 B1
(45) Date of Patent: Dec. 25, 2001

(54) BOARD GAME

(75) Inventor: Peter J. Reese, Vancouver (CA)

(73) Assignee: Peter J. Reese Architect Ltd., Vancouver (CA)

( * ) Notice: Subject to any disclaimer, the term of this patent is extended or adjusted under 35 U.S.C. 154(b) by 0 days.

(21) Appl. No.: 09/575,450

(22) Filed: May 22, 2000

(51) Int. Cl.[7] ..... A63F 3/00
(52) U.S. Cl. ..... 273/243; 273/287; 273/284
(58) Field of Search ..... 273/283, 284, 273/276, 236, 429–432, 157 R, 153 S, 249, 248

(56) References Cited

U.S. PATENT DOCUMENTS 5,280,914 * 1/1994 Selby et al. ..... 273/287
5,288,068 * 2/1994 Roth ..... 273/272
5,607,160 * 3/1997 Stevens et al. ..... 273/249

* cited by examiner

*Primary Examiner*—Benjamin H. Layno
*Assistant Examiner*—V K Mendiratta
(74) *Attorney, Agent, or Firm*—Elbie R. de Kock

(57) ABSTRACT

Apparatus for playing a game comprises a board and plurality of playing pieces for placement on the board during play of the game for tracking the progress of the game. The board is demarcated into a number of playing areas. Each playing area is subdivided into a plurality of abutting playing spaces. The playing areas are arranged in partially overlapping relationship so that the playing areas have at least some of the playing spaces in common. A set of cards for playing a game is also provided. Each card has a number of items selected from a predetermined category printed thereon. The category is identified on the card. The items are arranged in subgroups according to different degrees of difficulty regarding their perceived recognizability as being members of a set falling within the category.

13 Claims, 8 Drawing Sheets

BOARD GAME

FIELD OF THE INVENTION

This invention generally relates to a game, such as a game that may be played on a board.

SUMMARY OF THE INVENTION

According to the invention there is provided a board for playing a game and a plurality of playing pieces for placement on the board during play of the game for tracking the progress of the game, wherein the board is demarcated into a number of playing areas, each playing area being subdivided into a plurality of abutting playing spaces, the playing areas being arranged in partially overlapping relationship, whereby the playing areas have at least some of said playing spaces in common.

The playing areas may be colour-coded to distinguish the playing areas from one another and each playing area may be provided with a set of said playing pieces which is correspondingly colour-coded. The playing spaces of each colour-coded playing area may correspond in number with the correspondingly colour-coded set of playing pieces.

At least some of the playing spaces of each colour-coded playing area may have different shapes. A correspondingly shaped playing piece may be provided for each of the playing spaces of each colour-coded playing area.

In one embodiment of the invention the playing spaces are annular-shaped.

The playing areas may form a common area of overlap where all four of the playing areas are arranged in overlapping relationship, the playing areas being symmetrically arranged relative to said common area of overlap.

The board game apparatus may further comprise a plurality of word cards, each word card respectively having printed thereon different items selected from a predetermined category. The items may comprise single words, such as nouns, or two or more words forming phrases conveying information, such as the first line of a poem or the name of a song, or any other information falling within a predetermined category. The items may further be grouped in sub-categories according to different degrees of difficulty, regarding their recognizability as being members of a set falling within the category.

The board game apparatus may further comprise a dodecahedronal die. The die may comprise four groups of plane faces, each group of faces comprising three angularly abutting faces with each group having a distinctive colour coding, the three faces of each group respectively having one, two and three dots thereon.

The board game apparatus may also comprise a timer for determining a length of time for executing an action during play of the game and a bell for audibly signalling an end of a time period.

According to another aspect of the invention there is provided a set of cards for playing a game, each card having printed thereon items selected from a predetermined category, which category is identified on the card and wherein the items are arranged in subgroups according to different degrees of difficulty regarding their perceived recognizability as being members of a set falling within the category.

Further objects and advantages of the invention will become apparent from the description of preferred embodiments of the invention below.

BRIEF DESCRIPTION OF THE DRAWINGS

The invention is now described by way of example with reference to the accompanying drawings, in which.

DETAILED DESCRIPTION OF PREFERRED EMBODIMENT

Figure 1:
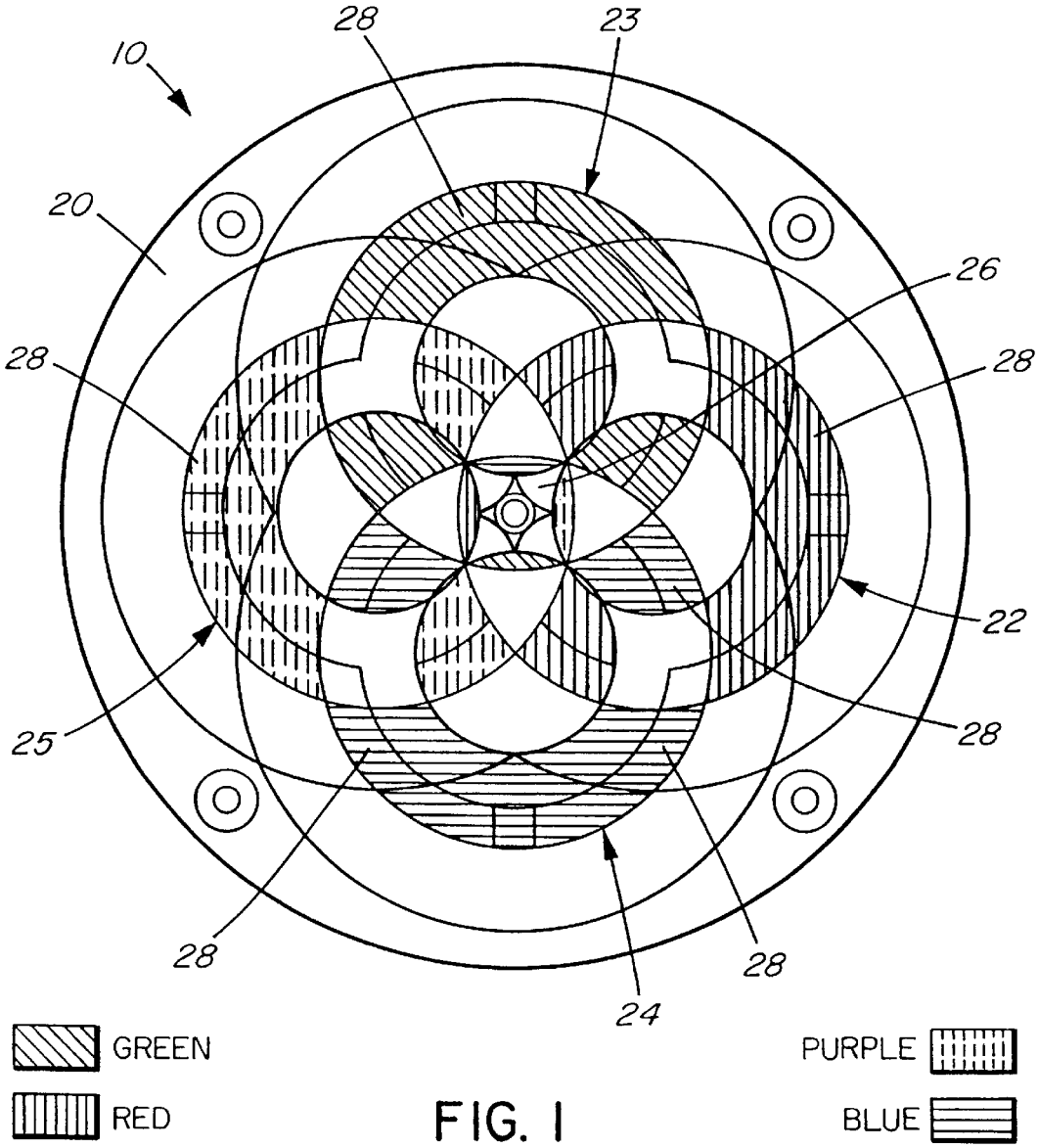
FIG. 1 is a plan view of a board for playing a board game.
Figure 3:
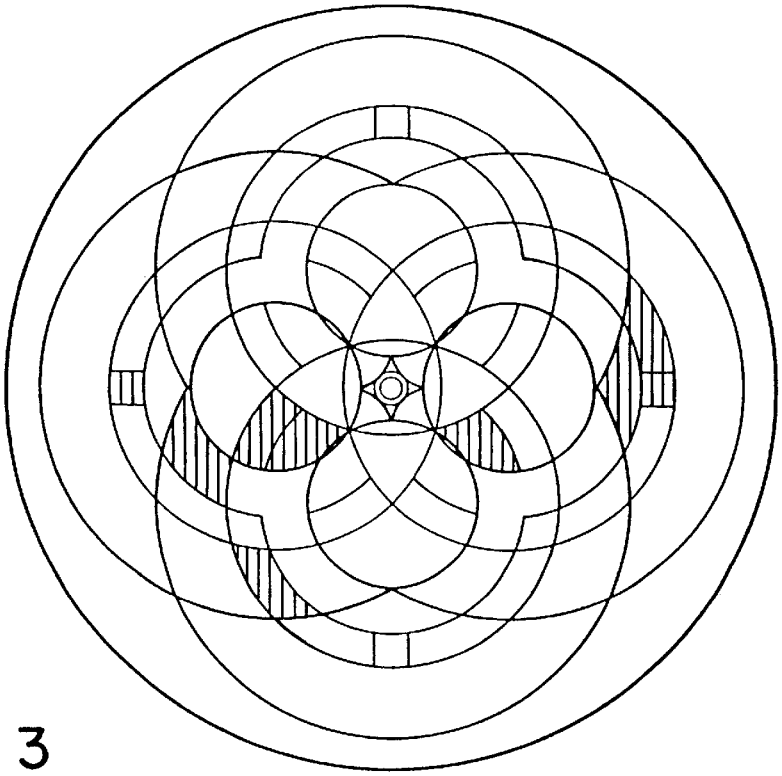
FIG. 3 is a view of the board of FIG. 1 showing an example after one round of play, as played by four sides.
Figure 4:
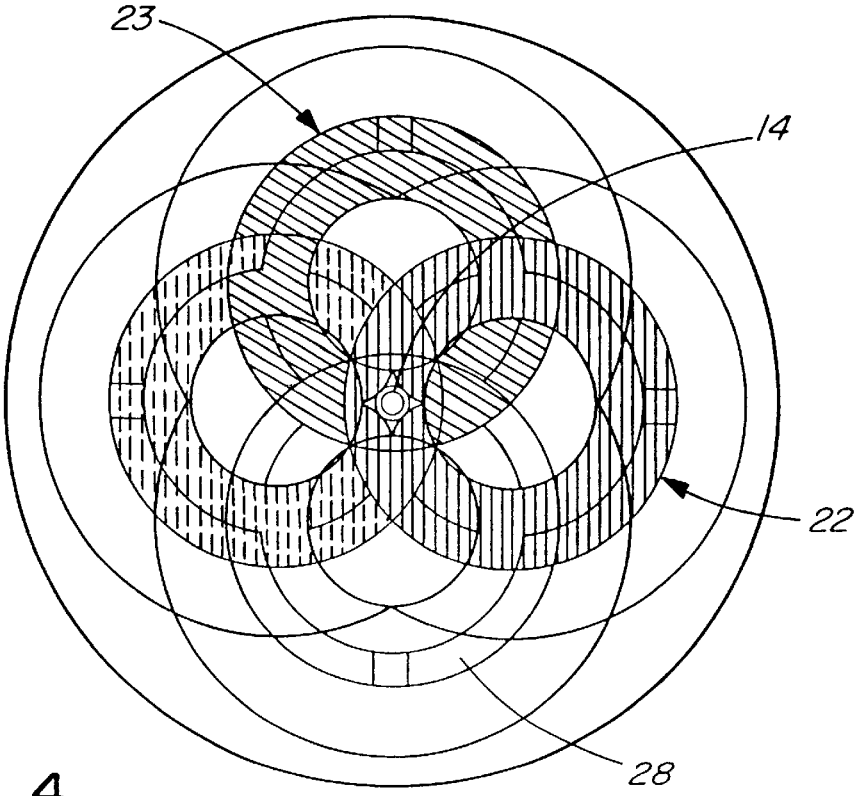
FIG. 4 is a view of the board of FIG. 1 showing an example of the board as at the game's end when played by three sides, with the side represented by the unbroken annular playing area having won the game.
Figure 5:
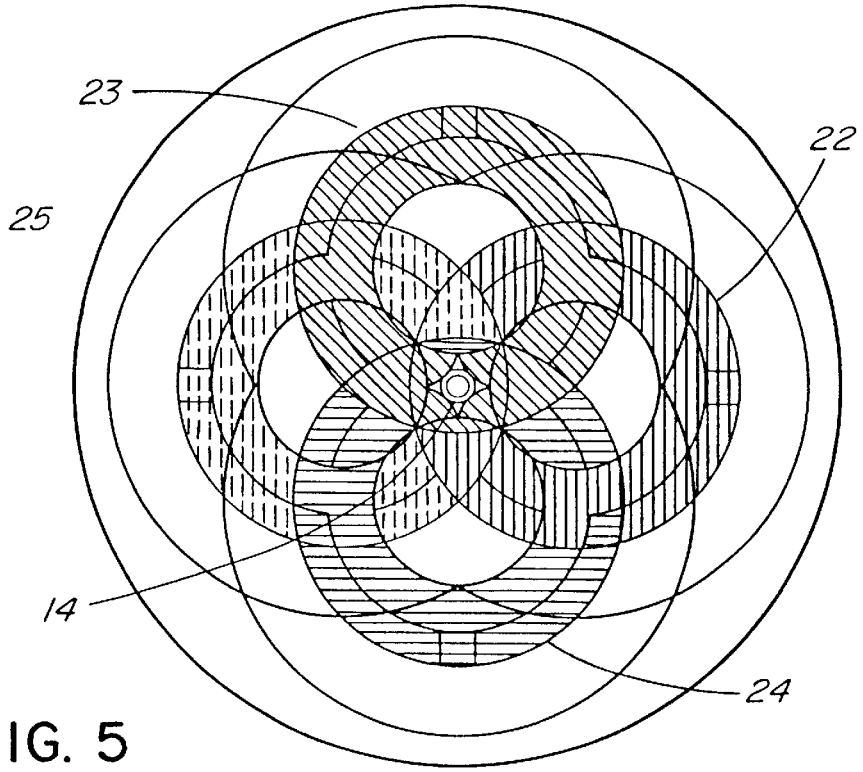
FIG. 5 is a view of the board of FIG. 1 showing an example of the board as at the game's end when played by four sides, with the side represented by the unbroken annular playing area having won the game.
Figure 6:
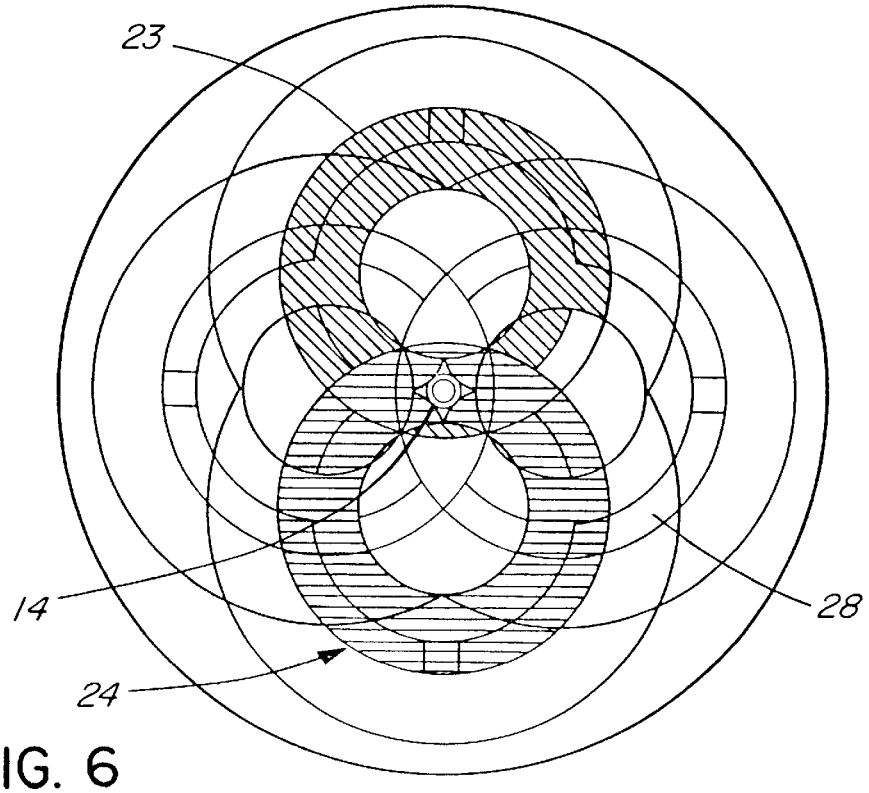
FIG. 6 is a view of the board of FIG. 1 showing an example of the board as at the game's end when played by two sides with the side represented by the unbroken annular playing area having won the game.
Figure 7:
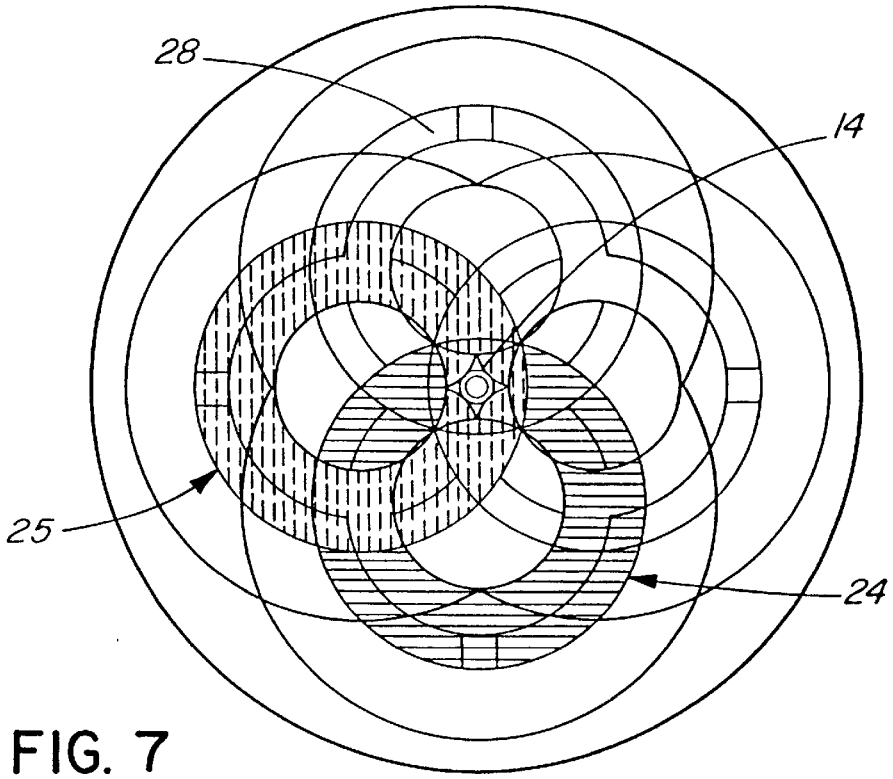
FIG. 7 is a view of the board of FIG. 1 showing an example of the board as at the game's end when played by two sides with the side represented by another unbroken annular playing area having won the game.

In the present example apparatus for playing a board game comprises a board, generally indicated by the reference numeral 10 in FIG. 1, and a plurality of different playing pieces, indicated by the reference numeral 12 in FIG. 3, the drawing being a demonstrative example of some of the playing pieces 12 placed on the board 10 during the course of play.

The board 10 is circular in shape and comprises a playing surface 20 with four playing areas 22, 23, 24 and 25 demarcated thereon. The playing areas 22 to 25 are in the form of partially overlapping annular formations or rings. A central playing area 26 is formed at a location where all four of the playing areas 22 to 25 overlap. As can be seen, the annular playing areas 22 to 25 are quadrantically arranged with respect to the central playing area 26.

In order to distinguish the playing areas 22 to 25 from each other, they are colour-coded, e.g. they are coloured red(22), green(23), blue(24) and purple(25). Different hatchings are used in FIG. 1 (as well as in FIGS. 4 to 7) to indicate the different colours as per the key provided with FIG. 1.

Each playing area 22 to 25 is further subdivided into twenty five abutting playing spaces 28 for receiving the playing pieces 12 during the course of playing the game, as will be described below. A matching playing piece 12 is provided for each playing space 28.

If desired, the playing spaces 28 may be recessed to snugly receive the playing pieces 12.

Figure 2:
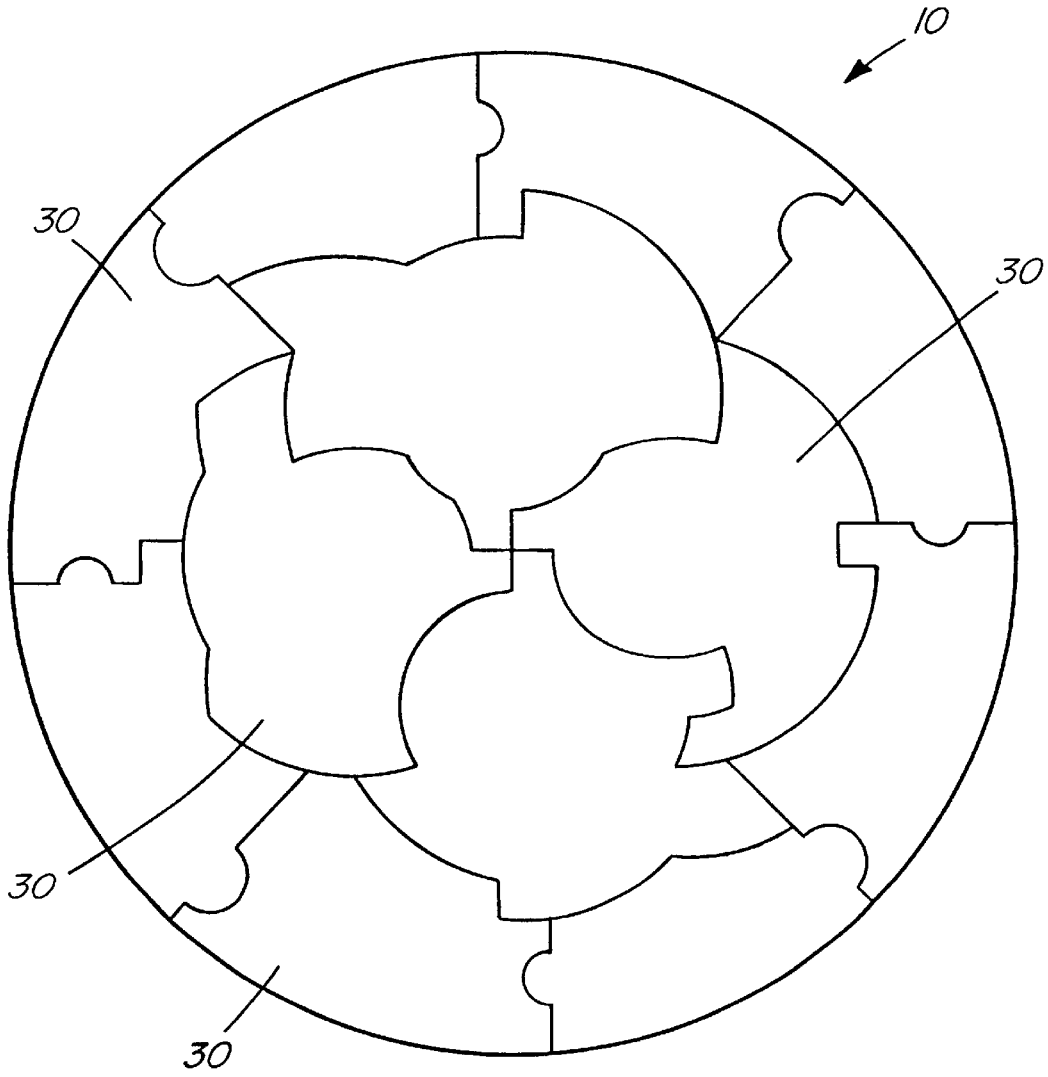
FIG. 2 is a view similar to FIG. 1 but showing the board comprising twelve interlocking sections which can be dismantled for storage purposes.

In order to facilitate storage, the board 10 is provided in the form of a number of interlocking segments 30, as shown in FIG. 2, to provide for disassembly of the board 10. However, the board 10 may also be displayed on a computer screen or monitor and provided with suitable software simulating the apparatus for playing the game so that the game may be played electronically, e.g. by a group of players at one location or by players at different locations using the internet.

Figure 11:
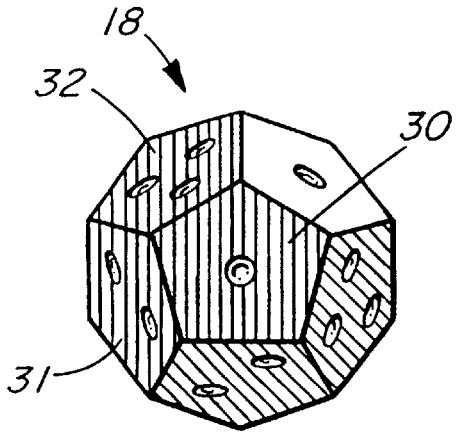
FIG. 11 is a three-dimensional view of a dodecahedronal die for use in playing the board game.

A dodecahedronal die 18, as shown in FIG. 11, may also be provided. The die 18 has four groups of plane faces, each group comprising three angularly abutting plane faces 30, 31 and 32. Each group of plane faces is colour coded, being respectively red, green, blue and purple to correspond with the colours of the playing areas 22 to 25.

Each plane face 30, 31, 32 has a marking for score identification, the first plane face 30 having one dot, the second plane face 31 having two dots and the third plane face 32 having three dots. Thus, when the die is thrown by a side of a particular colour, the score on a correspondingly coloured face is taken into account for that side.

Figure 8:
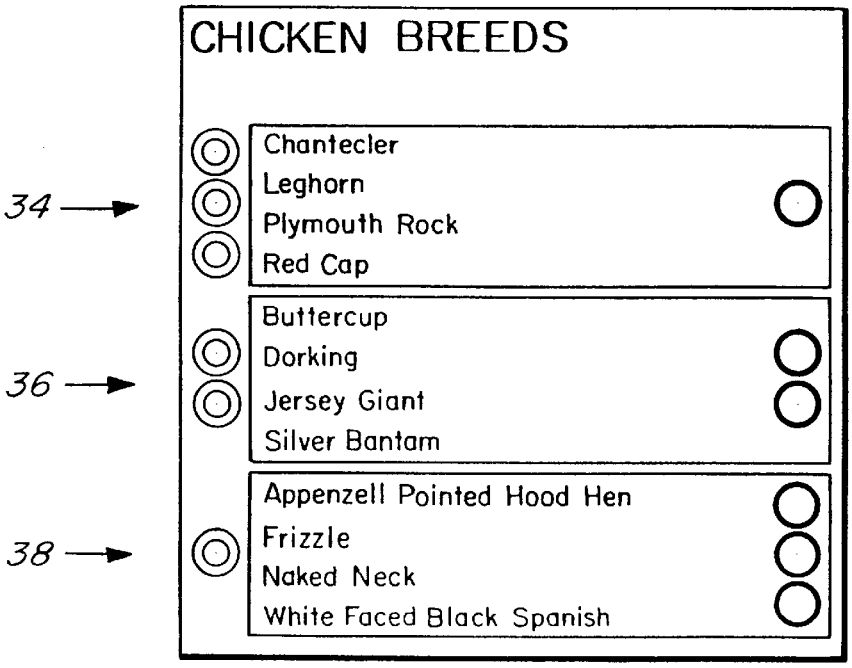
FIG. 8 shows the one side of a word card for use in playing the board game, depicting nouns selected from the category "Chicken Breeds", which nouns are subcategorized into three subgroups of four nouns per subgroup.

A number of word cards 16, as shown in FIG. 8, is also provided. Each word card 16 has one or more words printed thereon. The words constitute a topic or subject category which is identified by a heading at the top of the card 16, such as "Chicken Breeds" in the present example.

Different subject categories are provided on the cards 16. The subject categories are intended to tap randomly into the entire human body of knowledge and may comprise the inanimate world, life forms; places; things; people; cultural manifestations; cultural productions; names and terms; or any other subject.

Each card 16 contains a particular category. Each category is further subcategorized into subgroups of increasing difficulty, e.g. a number of topics 34 probably known to a player, topics 36 possibly known to a player and topics 38 probably not known to a player, as shown in FIG. 8.

In the present example the word cards 16 comprise a set of 360 word cards 16, provided as ten packs of cards 16, each pack comprising thirty-six cards 16. The cards 16 of each pack respectively have words from one of the subject groups printed thereon, e.g. if there are ten different categories, each pack has three cards from each category.

To facilitate identification, the cards 16 of the different categories may be colour coded with a distinctive colour for each category.

The playing pieces 12 are shards matching the playing spaces 28 on each of the playing areas 22 to 25. The playing pieces or shards 12 are provided as four differently coloured sets, i.e. red, green, blue and purple, to match the playing spaces 28.

Figure 14:
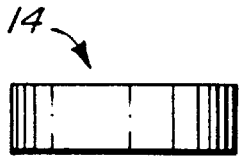
FIGS. 14 and 15, respectively show a side view and a plan view of a ring for use in playing the board game.
Figure 15:
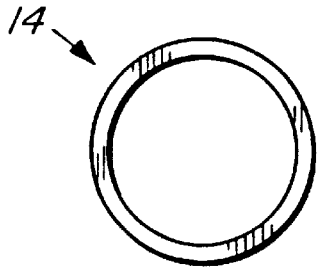

A ring 14, as shown in FIGS. 14 and 15, for use in playing the game, is also provided. The ring 14 is of brass and has a diameter of about 24 mm.

Figure 9:
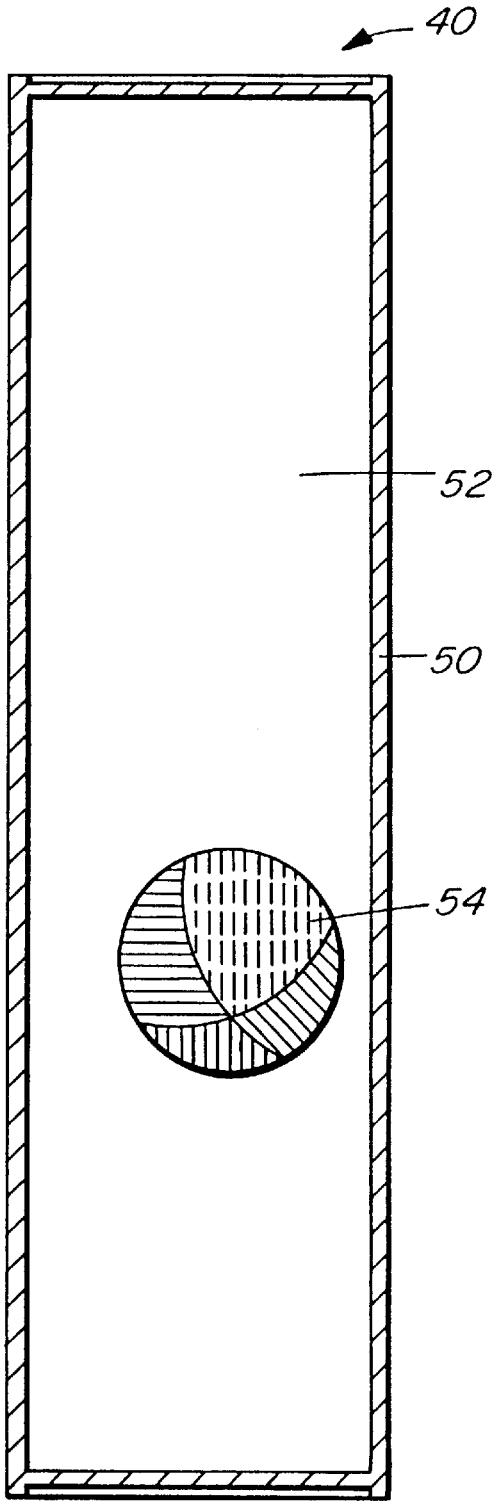
FIG. 9 shows a longitudinal section of a timer for use in playing the board game.
Figure 10:
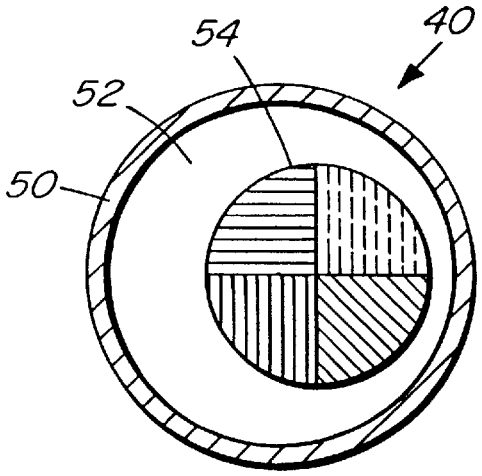
FIG. 10 shows a cross-section of the timer of FIG. 9.

A timer 40 (FIGS. 9 and 10) for determining the length of time permitted for executing certain actions during play of the game is also provided. although not one of those on the word card 16, does fall within the subject category identified on the word card 16, the Hander will be penalized with three points.

For each point awarded to a side on the scoring basis set out below, a side may place one shard 12 on a playing space 28 of that side's playing area 22, 23, 24 or 25. Once placed, a shard 12 may not be moved, except by another side, as described below. Shards 12 are placed on the playing area 22, 23, 24, 25 in the order of the points gained in a particular round, with the side gaining the most points going last. If there is a tie in the points gained, the order of placing of the shards 12 may be decided by the cast of the die 18.

If a side's shard 12 is to be placed by one side on an area of overlap where there is already a shard 12 of a another side, the one side may remove the other side's shard 12 and replace it with its own.

On completion of each round, the word cards 16 which have been used are returned face down to the bottom of the pack of word cards 16 used during play.

At some point one side will complete placing all twenty-five shards on its playing area 22, 23, 24 or 25. Once a side has completed placing all its shards 12, a brass-ring round proceeds. This round is similar to a normal round except that the side attempting to place the ring 14 on the central playing area 26, casts the die to determine which group 34, 36, 38 on the word card 16 selected by that side's Hander will be used. The side attempting to place the ring 14 gets the first chance to attempt to identify the Ringer of that side's Hander. If the side correctly identifies the Ringer, the ring 14 is placed on the and may comprise the inanimate world, life forms; places; things; people; cultural manifestations; cultural productions; names and terms; or any other subject.

Each card 16 contains a particular category. Each category is further subcategorized into subgroups of increasing difficulty, e.g. a number of topics 34 probably known to a player, topics 36 possibly known to a player and topics 38 probably not known to a player, as shown in FIG. 8.

In the present example the word cards 16 comprise a set of 360 word cards 16, provided as ten packs of cards 16, each pack comprising thirty-six cards 16. The cards 16 of each pack respectively have words from one of the subject groups printed thereon, e.g. if there are ten different categories, each pack has three cards from each category.

To facilitate identification, the cards 16 of the different categories may be colour coded with a distinctive colour for each category.

The playing pieces 12 are shards matching the playing spaces 28 on each of the playing areas 22 to 25. The playing pieces or shards 12 are provided as four differently coloured sets, i.e. red, green, blue and purple, to match the playing spaces 28.

A ring 14, as shown in FIGS. 14 and 15, for use in playing the game, is also provided. The ring 14 is of brass and has a diameter of about 24 mm.

A timer 40 (FIGS. 9 and 10) for determining the length of time permitted for executing certain actions during play of the game is also provided.

The timer 40 comprises a cylindrical container 50 which is of a transparent plastic material, such as lucite. The container 50 is filled with a clear viscous liquid 52, e.g. water, with a plastic ball 54 in the liquid 52. The ball 54 has a specific gravity which causes it to rise through the liquid 52 from the bottom to the top of the container 50 in a predetermined amount of time, e.g. one minute. The ball 54 is multicolored to match the colours of the playing areas 22 to 25, for decorative purposes.

In the present example the container 50 has a height of 151 mm, an outside diameter of 39 mm and a wall thickness of 2 mm. The ball 54 has a diameter of 23 mm.

Figure 12:
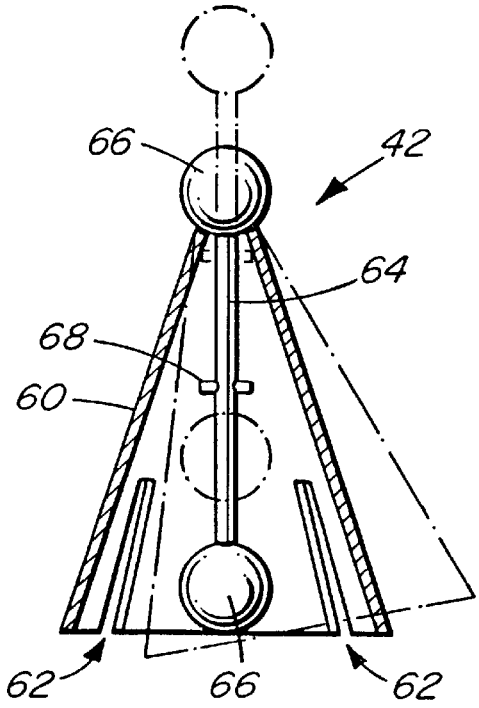
FIGS. 12 and 13 respectively show a section and plan view of a bell for use in playing the board game.
Figure 13:
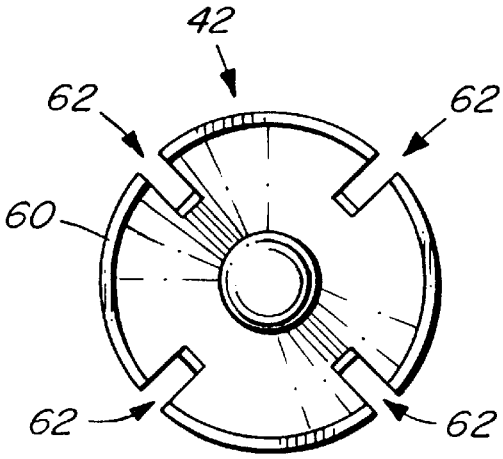

A bell 42, as shown in FIGS. 12 and 13, is further provided to signal the termination of a time period. It comprises a brass cone 60 provided with four slots 62 extending from its base. A brass rod 64 having a brass ball 66 at each of its opposite ends is suspended through a hole at the apex of the cone 60. A transverse brass stub 68 is located at the center of the rod 64. The bell 42 is lifted by means of the ball 66 at the upper end of the rod 60 in order to ring it.

Figure 16:
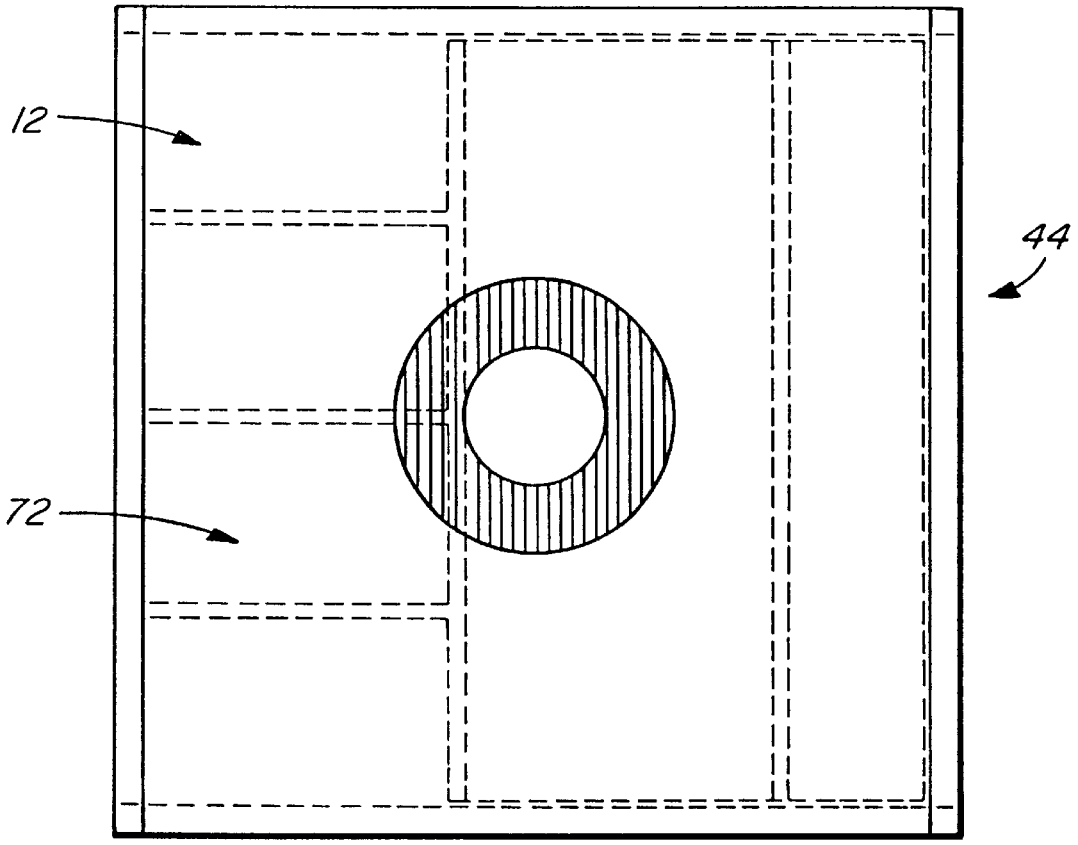
FIGS. 16 and 17, respectively show a plan view and side view of a container for the board game.
Figure 17:
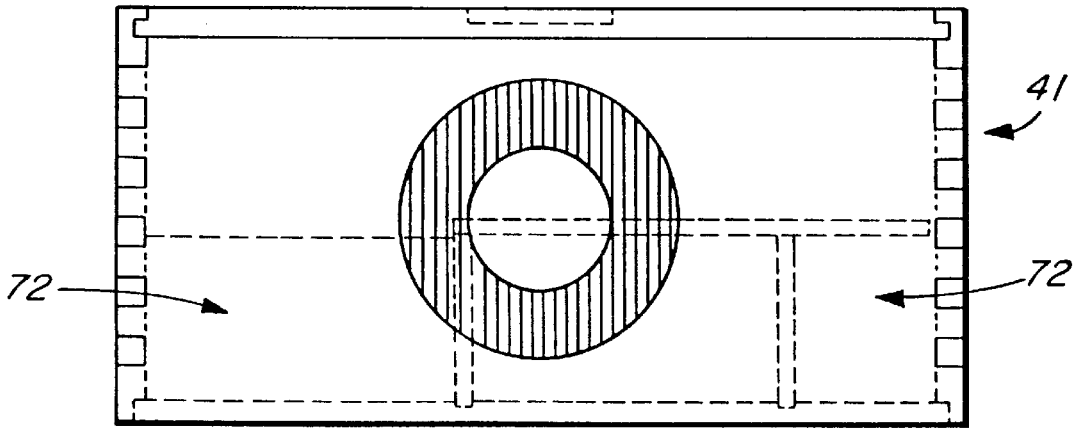

A container 44 (FIGS. 16 and 17) for storing the board game apparatus is also provided. As shown, the container 44 is provided with compartments 72 for storing the various pieces.

The Method of Play

In playing the board game 10, the players arrange themselves into two, three or four sides around the assembled board 10. Each side plays the colour of the playing area 22 to 25 nearest it. The pack of word cards 16 to be used for playing the game is shuffled and the pack placed face down within reach of the sides. Each side is issued twenty-five shards 12 corresponding in colour to the playing area 22 to 25 of each side.

The game is played in rounds. At each round, each side is both "Hander" and "Fingerer".

Each side in turn selects a word card 16 from the top of the pack of the word cards 16 and prevents the other side(s) from viewing the word card 16. The die 18 can be cast to decide the order in which the sides are to select a card 16. For example, the first colour uppermost corresponding with the colour of a playing area of one of the sides playing, determines that that side can be the first to select a card. The second and third in order can be selected in similiar fashion.

If there are two sides, each side plays against the other at each round. If there are three or four sides, each side alternates playing against the other sides in a regular order. The intent is that each side plays an equal number of rounds against the other side. For example, if there are three sides, each side would alternate being a Hander to the side on its left and Fingerer to the side on its right during a first round, and then reverse during the next round. Where there are four sides, two sides would play against each other in a predetermined order such as blue vs. purple and red vs. green during the first round, then in the next round, blue vs. green and purple vs. red and finally blue vs. red and purple vs. green in the third round and then repeat the order.

In each round, once each side has selected and reviewed a word card 16, each side selects a subgroup 34, 36, 38. With reference to, for example, the word card depicted in FIG. 8, only three of the four chicken breeds of the category 34, 36 or 38 are selected. The side with the example card then adds a fourth breed as a "Ringer", which is a contrived word, to the three selected breeds. The intent is that the Ringer should be a deceptive representation of being a member of the subgroup 34, 36, 38. In the above example, the three breeds selected from the category 34, 36 or 38 together with the Ringer are notated on note paper. The timer 40 and bell 42 may be used to limit the length of time allotted to each side for this purpose.

Taking turns, a Hander reads the name of the topic or subject category on the word card 16 to its Fingerer. For example, and again referring to FIG. 8, the name of the category is "Chicken Breeds". The Fingerer is handed the note paper containing the four chicken breeds for review. The Fingerer then selects one of the four breeds on the note paper as being the Ringer. At the end of each round, each Fingerer in turn announces to their Hander their selection of the item considered to be the Ringer.

As stated above, for each round, a side is both a Hander and a Fingerer. Therefore, if red is playing against green, red hands green its card and green hands red its card. Each side then tries to finger the other's Ringer.

According to the preferred method of playing the board game 10, the intent is that the Ringer should not be a member of the particular subject category 34, 36, 38. If the Fingerer can show that the Ringer, although not one of those on the word card 16, does fall within the subject category identified on the word card 16, the Hander will be penalized with three points.

For each point awarded to a side on the scoring basis set out below, a side may place one shard 12 on a playing space 28 of that side's playing area 22, 23, 24 or 25. Once placed, a shard 12 may not be moved, except by another side, as described below. Shards 12 are placed on the playing area 22, 23, 24, 25 in the order of the points gained in a particular round, with the side gaining the most points going last. If there is a tie in the points gained, the order of placing of the shards 12 may be decided by the cast of the die 18.

If a side's shard 12 is to be placed by one side on an area of overlap where there is already a shard 12 of a another side, the one side may remove the other side's shard 12 and replace it with its own.

On completion of each round, the word cards 16 which have been used are returned face down to the bottom of the pack of word cards 16 used during play.

At some point one side will complete placing all twenty-five shards on its playing area 22, 23, 24 or 25. Once a side has completed placing all its shards 12, a brass-ring round proceeds. This round is similar to a normal round except that the side attempting to place the ring 14 on the central playing area 26, casts the die to determine which group 34, 36, 38 on the word card 16 selected by that side's Hander will be used. The side attempting to place the ring 14 gets the first chance to attempt to identify the Ringer of that side's Hander. If the side correctly identifies the Ringer, the ring 14 is placed on the central area 26 and the game is won by the side so placing the ring 14.

Scoring

The first group 34 of topics on the word card 16 is valued at three points to the Hander if the Fingerer fails to identify the Ringer and is valued at one point to the Fingerer if the Fingerer correctly identifies the Ringer.

The second group 36 on the word card 16 is valued at two points to the Hander if the Fingerer fails to identify the Ringer and is valued at two points to the Fingerer if the Ringer is identified by the Fingerer.

The third category 38 on the word card 16 is valued at one point to the Hander if the Fingerer fails to select the Ringer and is valued at three points to the Fingerer if the Fingerer correctly identifies the Ringer.

One point is required to place a shard 12 on a playing space 28.

In accordance with the scoring as described above, each side can score from 0 to 6 points per round.

Although certain preferred embodiments of the present invention have been shown and described in detail, it should be understood that various changes and modifications may be made therein without departing from the scope of the appended claims.

What is claimed is:

1. Board game apparatus comprising:

a board for playing a game and a plurality of playing pieces for placement on the board during play of the game for tracking the progress of the game, wherein the board is demarcated into a number of playing areas, each playing area being subdivided into a plurality of playing spaces, the playing areas being arranged in partially overlapping relationship, whereby each playing area has at least one of said playing spaces in common with each one of the other playing areas, wherein the playing areas are colour-coded to distinguish the playing areas from one another and each playing area is provided with a set of said playing pieces which is correspondingly colour-coded.

2. The board game apparatus of claim 1, wherein the playing spaces of each colour-coded playing area correspond in number with the correspondingly colour-coded set of playing pieces.

3. The board game apparatus of claim 2, wherein at least some of the playing spaces of each colour-coded playing area have different shapes and wherein a correspondingly shaped playing piece is provided for each of said playing spaces of each colour-coded playing area.

4. The board game apparatus of claim 1, wherein said playing areas are annular-shaped.

5. The board game apparatus of claim 4, wherein the number of said playing areas is four.

6. The board game apparatus of claim 5, wherein said playing areas form a common area of overlap where all four of the playing areas are arranged in overlapping relationship, the playing areas being symmetrically arranged relative to said common area of overlap.

7. The board game apparatus of claim 1, wherein the board is displayed on a computer screen or monitor.

8. The board game apparatus of claim 1, further comprising a plurality of word cards, each word card having items selected from a predetermined category printed thereon.

9. The board game apparatus of claim 8, wherein the items on each card are grouped in subcategories according to different degrees of difficulty.

10. The board game apparatus of claim 1, further comprising a dodecahedronal die.

11. The board game apparatus of claim 10, wherein the die comprises four groups of plane faces, each group of faces comprising three angularly abutting faces, each said group having a distinctive colour coding and the three faces of each group respectively having one, two and three dots thereon.

12. The board game apparatus of claim 1 further comprising a timer for determining a length of time for executing an action during play of the game.

13. The board game apparatus of claim 1, further comprising a set of cards, each card having printed thereon items selected from a predetermined category, which category is identified on the card and wherein the items are arranged in subgroups according to different degrees of difficulty regarding their perceived recognizability as being members of a set falling within the category.

* * * * *